US007984773B2

(12) United States Patent
Oothoudt

(10) Patent No.: US 7,984,773 B2
(45) Date of Patent: Jul. 26, 2011

(54) SONIC DRILL BIT FOR CORE SAMPLING

(75) Inventor: Thomas J. Oothoudt, Little Falls, MN (US)

(73) Assignee: Longyear TM, Inc., South Jordan, UT (US)

( * ) Notice: Subject to any disclaimer, the term of this patent is extended or adjusted under 35 U.S.C. 154(b) by 107 days.

(21) Appl. No.: 12/346,395

(22) Filed: Dec. 30, 2008

(65) Prior Publication Data

US 2009/0283326 A1 Nov. 19, 2009

Related U.S. Application Data

(60) Provisional application No. 61/052,904, filed on May 13, 2008.

(51) Int. Cl.
*E21B 10/02* (2006.01)

(52) U.S. Cl. ..... 175/403; 175/395; 175/405

(58) Field of Classification Search ..... 175/403–405.1, 175/395

See application file for complete search history.

(56) References Cited

U.S. PATENT DOCUMENTS

| | | | | |
|---|---|---|---|---|
| 2,831,659 | A | | 4/1958 | Kukuchek et al. |
| 2,856,157 | A | | 10/1958 | Chapin et al. |
| 3,095,051 | A | | 6/1963 | Robinsky et al. |
| 3,331,455 | A | * | 7/1967 | Anderson, Jr. et al. ..... 175/403 |
| 3,360,960 | A | | 1/1968 | Massey |
| 3,651,876 | A | | 3/1972 | Henson |
| 3,794,127 | A | | 2/1974 | Davis |
| 3,888,320 | A | | 6/1975 | Maxwell |
| 3,981,371 | A | | 9/1976 | Wallis |
| 4,189,015 | A | | 2/1980 | Acker et al. |
| 4,403,665 | A | | 9/1983 | Bodine |
| 4,460,202 | A | | 7/1984 | Chance et al. |
| 4,465,146 | A | | 8/1984 | Fitch |
| 4,484,642 | A | | 11/1984 | Evans |
| 4,699,226 | A | | 10/1987 | Muller et al. |
| 4,811,800 | A | | 3/1989 | Hill et al. |
| 4,912,415 | A | | 3/1990 | Sorensen |
| 4,942,932 | A | | 7/1990 | Bracewell |
| 4,949,797 | A | | 8/1990 | Isom |
| 5,040,622 | A | | 8/1991 | Winship et al. |
| 5,042,600 | A | | 8/1991 | Finnegan et al. |
| 5,562,169 | A | | 10/1996 | Barrow |
| 5,788,401 | A | | 8/1998 | Drenth |
| 6,109,620 | A | | 8/2000 | Roberts et al. |
| 6,196,598 | B1 | | 3/2001 | Yao |
| 7,448,832 | B2 | | 11/2008 | Annanolli et al. |
| 7,631,705 | B1 | | 12/2009 | Harte et al. |
| 2002/0112895 | A1 | | 8/2002 | Hong et al. |
| 2002/0129975 | A1 | | 9/2002 | Barta |
| 2003/0226694 | A1 | | 12/2003 | Moseley |

(Continued)

OTHER PUBLICATIONS

International Search Report and Written Opinion dated Jan. 14, 2010 as issued in International Application No. PCT/US2009/043809 filed May 13, 2009.

(Continued)

*Primary Examiner* — Giovanna C Wright
(74) *Attorney, Agent, or Firm* — Workman Nydegger

(57) ABSTRACT

A drill bit for core sampling includes a body having a central axis and first end having a tapered outer surface and a radius transverse to the central axis, and an insert having a cutting surface on the first end oriented at an axial angle relative to the radius to move material displaced during drilling away from the first end.

21 Claims, 6 Drawing Sheets

U.S. PATENT DOCUMENTS

2006/0076162 A1 4/2006 Tchakarov et al.

OTHER PUBLICATIONS

U.S. Appl. No. 12/260,800, filed Oct. 29, 2008, Oothoudt.
Office Action dated Apr. 12, 2010 from U.S. Appl. No. 12/260,800, filed Oct. 29, 2008 (13 pages).
Notice of Allowance dated Jul. 19, 2010 from U.S. Appl. No. 12/260,800, filed Oct. 29, 2008 (4 pages).
Issue Notification dated Sep. 15, 2010 from U.S. Appl. No. 12/260,800, filed Oct. 29, 2008 (1 page).

* cited by examiner

SONIC DRILL BIT FOR CORE SAMPLING

CROSS-REFERENCE TO RELATED APPLICATIONS

This application claims the benefit of U.S. Patent Application Ser. No. 61,052,904 filed May 13, 2008, which is hereby incorporated by reference in its entirety.

BACKGROUND

1. The Field of the Invention

This application relates generally to drill bits and methods of making and using such drill bits. In particular, this application relates to sonic drill bits that are used to collect a core sample, as wells as methods for making and using such sonic drill bits.

2. The Relevant Technology

Often, drilling processes are used to retrieve a sample of a desired material from below the surface of the earth. In a conventional drilling process, an open-faced drill bit is attached to the bottom or leading edge of a core barrel. The core barrel is attached to a drill string, which is a series of threaded and coupled drill rods that are assembled section by section as the core barrel moves deeper into the formation. The core barrel is rotated and/or pushed into the desired sub-surface formation to obtain a sample of the desired material (often called a core sample). Once the sample is obtained, the core barrel containing the core sample is retrieved. The core sample can then be removed from the core barrel.

An outer casing with a larger diameter than the core barrel can be used to maintain an open borehole. Like the core barrel, the casing can include an open-faced drill bit that is connected to a drill string, but both with a wider diameter than the core barrel. The outer casing is advanced and removed in the same manner as the core barrel by tripping the sections of the drill rod in and out of the borehole.

In a wireline drilling process, a core barrel can be lowered into an outer casing and then locked in place at a desired position. The outer casing can have a drill bit connected to a drill string and is advanced into the formation. Thereafter, the core barrel and the casing advance into the formation, thereby forcing a core sample into the core barrel. When the core sample is obtained, the core barrel is retrieved using a wireline system, the core sample is removed, and the core barrel is lowered back into the casing using the wireline system.

As the core barrel advances, the material at and ahead of the bit face is displaced. This displaced material will take the path of the least resistance, which can cause the displaced material to enter the core barrel. The displaced material can cause disturbed, elongated, compacted, and in some cases, heated core samples. In addition, the displaced material is often pushed outward into the formation, which can cause compaction of the formation and alter the formation's undisturbed state.

Further, the displaced material can also enter the annular space between the outer casing and the borehole wall, causing increased friction and heat as well as causing the casing to bind and become stuck in the borehole. When the casing binds or sticks, the drilling process is slowed, or even stopped, because of the need to pull the casing and ream and clean out the borehole.

As well, bound or stuck casings may also require the use of water, mud or air to remove the excess material and free up the outer casing. The addition of the fluid can also cause sample disturbance and contamination of the borehole.

Additional difficulties can arise when drilling hard and/or dry formations. In particular, while drilling hard and/or dry formations, the displaced material can be difficult to displace. As a result, the material is often re-drilled numerous times creating heat, inefficiencies, and stuck casings.

BRIEF SUMMARY OF THE INVENTION

A drill bit for core sampling includes a body having a central axis and first end having a tapered outer surface and a radius transverse to the central axis and an insert having a cutting surface on the first end oriented at an axial angle relative to the radius to move material displaced during drilling away from the first end. Thus, these drill bits move the displaced material away from the first end and the entrance of the core barrel. This design allows for collection of highly representative, minimally disturbed core samples.

BRIEF DESCRIPTION OF THE DRAWINGS

The following description can be better understood in light of Figures, in which.

Figure 1A:
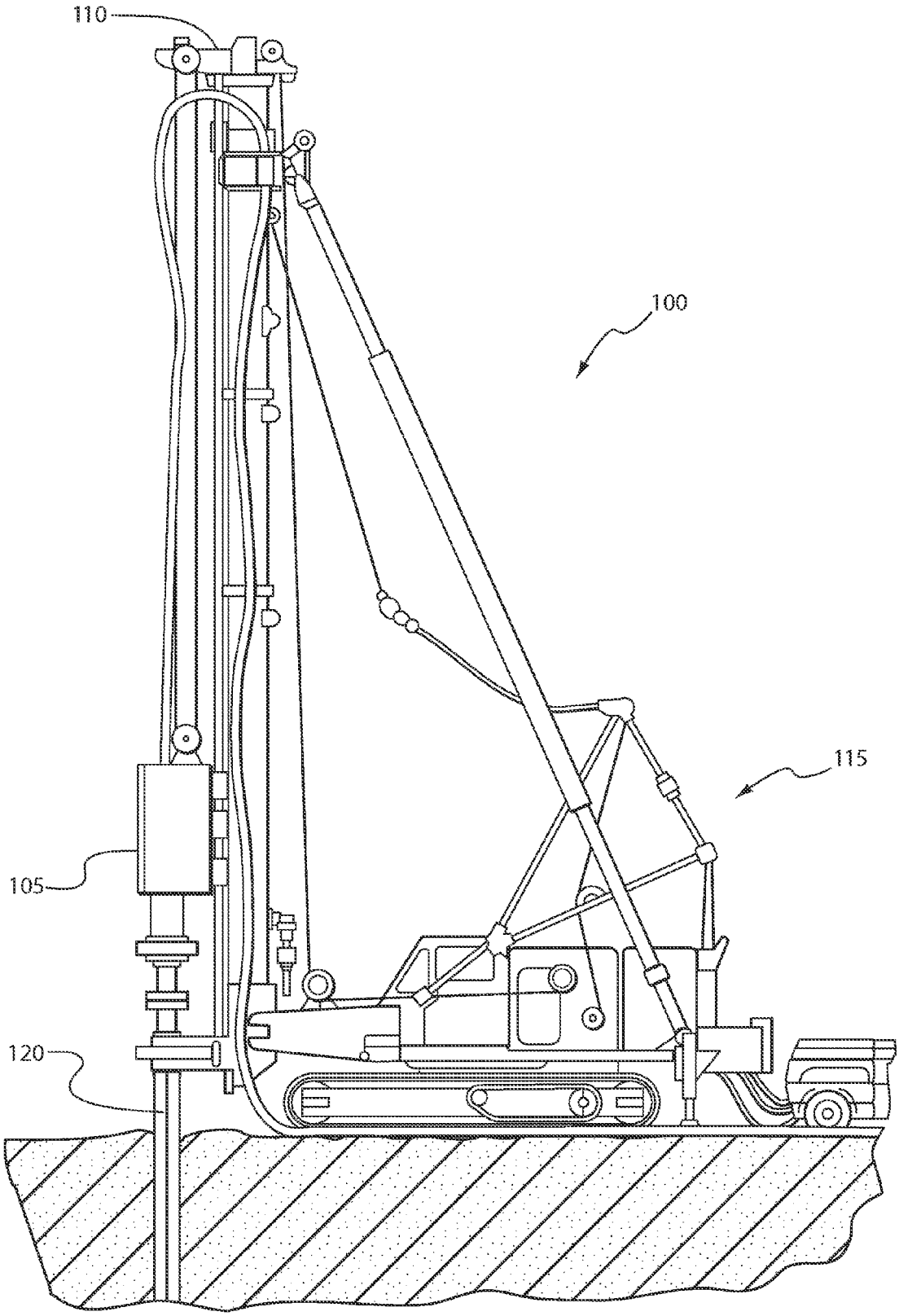
FIG. 1A illustrates a surface portion of a drilling system according to one example.

Together with the following description, the Figures demonstrate and explain the principles of the apparatus and methods for using the drill bits. In the Figures, the thickness and configuration of components may be exaggerated for clarity. The same reference numerals in different Figures represent the same component.

DETAILED DESCRIPTION

The following description supplies specific details in order to provide a thorough understanding. Nevertheless, the skilled artisan would understand that the apparatus and associated methods of using the apparatus can be implemented and used without employing these specific details. Indeed, the apparatus and associated methods can be placed into practice by modifying the illustrated apparatus and associated methods and can be used in conjunction with any other apparatus and techniques conventionally used in the industry. For example, while the description below focuses on sonic drill bits for obtaining core samples, the apparatus and associated methods could be equally applied in other drilling apparatuses and processes, such as diamond core drill bits and other vibratory and/or rotary drill systems.

Figure 1B:
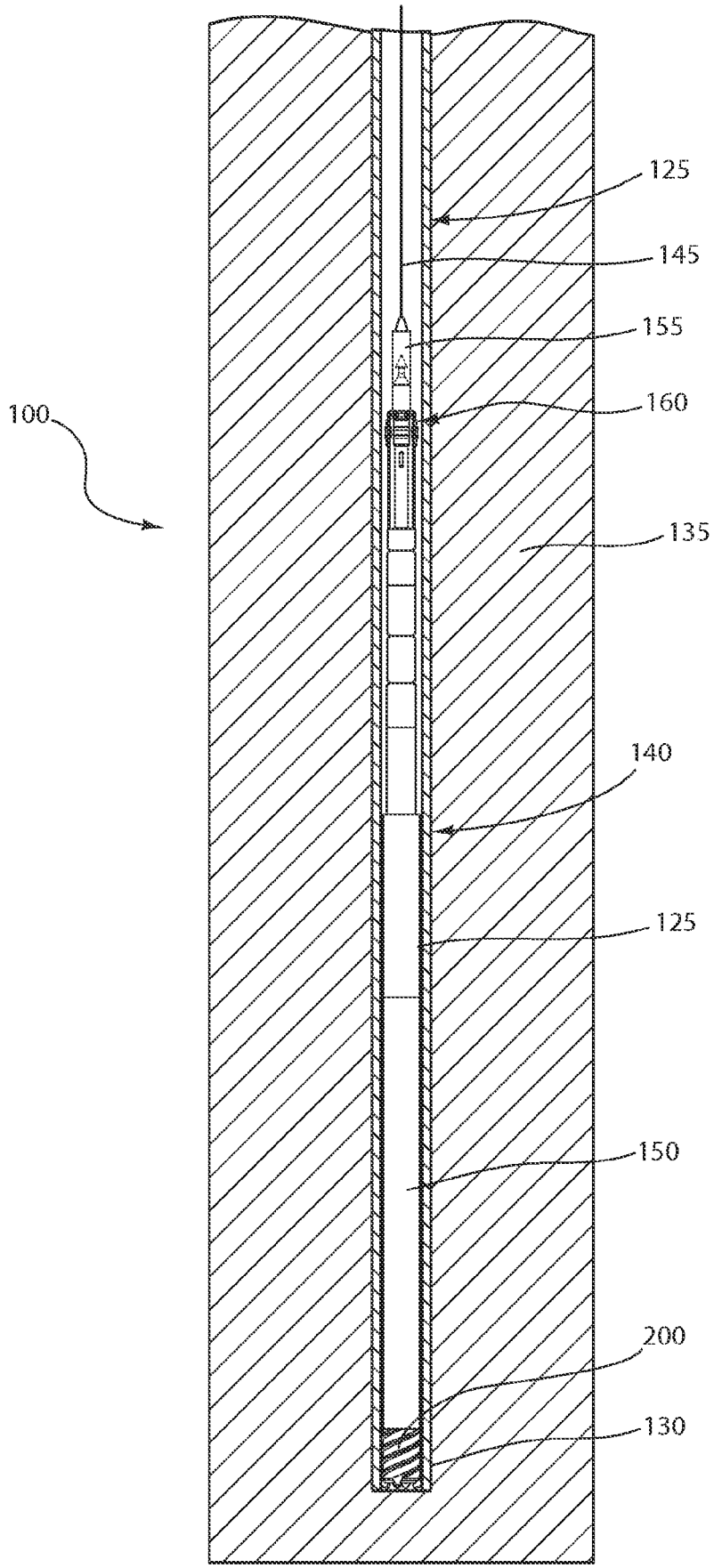
FIG. 1B illustrates a down-hole portion of a drilling system.
Figure 1C:
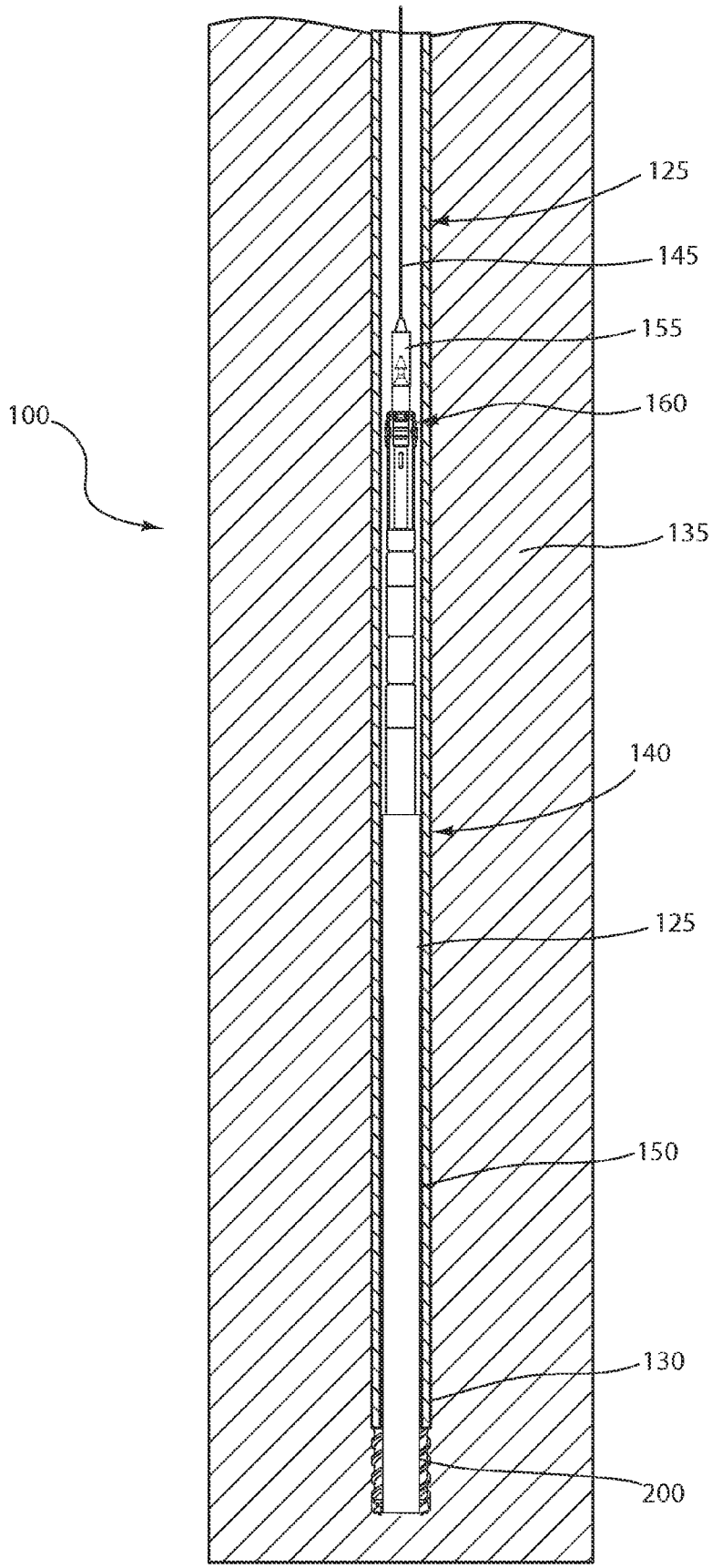
FIG. 1C illustrates a down-hole portion of a drilling system according to one example.

FIG. 1A-1C illustrate a drilling system 100 according to one example. In particular, FIG. 1A illustrates a surface portion of the drilling system 100 while FIG. 1B illustrates a subterranean portion of the drilling system. Accordingly, FIG. 1A illustrates a surface portion of the drilling system 100 that shows a drill head assembly 105. The drill head assembly 105 can be coupled to a mast 110 that in turn is coupled to a drill rig 115. The drill head assembly 105 is configured to have a drill rod 120 coupled thereto.

As illustrated in FIGS. 1A and 1B, the drill rod 120 can in turn couple with additional drill rods to form an outer casing 125. The outer casing 125 can be coupled to a first drill bit 130 configured to interface with the material to be drilled, such as a formation 135. The drill head assembly 105 can be configured to rotate the outer casing 125. In particular, the rotational rate of the outer casing 125 can be varied as desired during the drilling process. Further, the drill head assembly 105 can be configured to translate relative to the mast 110 to apply an axial force to the outer casing 125 to urge the drill bit 130 into the formation 135 during a drilling process. The drill head assembly 105 can also generate oscillating forces that are transmitted to the drill rod 120. These forces are transmitted from the drill rod 120 through the outer casing 125 to the drill bit 130.

The drilling system 100 also includes a core-barrel assembly 140 positioned within the outer casing 125. The core-barrel assembly 140 can include a wireline 145, a core barrel 150, an overshot assembly 155, and a head assembly 160. In the illustrated example, the core barrel 150 can be coupled to the head assembly 160, which in turn can be removably coupled to the overshot assembly 155. When thus assembled, the wireline 145 can be used to lower the core barrel 150, the overshot assembly 155, and the head assembly 160 into position within the outer casing 125.

The head assembly 160 includes a latch mechanism configured to lock the head assembly 160 and consequently the core barrel 150 in position at a desired location within the outer casing 125. In particular, when the core-barrel assembly 140 is lowered to the desired location, the latch mechanism associated with the head assembly 160 can be deployed to lock the head assembly 160 into position relative to the outer casing 125. The overshot assembly 155 can also be actuated to disengage the head assembly 160. Thereafter, the core barrel 150 can rotate with the outer casing 125 due to the coupling of the core barrel 150 to the head assembly 160 and of the head assembly 160 to the outer casing 125.

At some point it may be desirable to trip the core barrel 150 to the surface, such as to retrieve a core sample. To retrieve the core barrel 150, the wireline 145 can be used to lower the overshot assembly 155 into engagement with the head assembly 160. The head assembly 160 may then be disengaged from the drill outer casing 125 by drawing the latches into head assembly 160. Thereafter, the overshot assembly 155, the head assembly 160, and the core barrel 150 can be tripped to the surface.

In at least one example, a second drill bit, such as a sonic axial radial lift bit 200 (hereinafter referred to as lift bit 200) is coupled to the core barrel 150. As discussed above, the core barrel 150 can be secured to the outer casing 125. As a result, the lift bit 200 rotates with the core barrel 150 and the outer casing 125. In such an example, as the core barrel 150 and the outer casing 125 advance into the formation 135, the lift bit 200 sweeps the drilled material into an annular space between the core barrel 150 and the outer casing 125. Removing the material in such a manner can improve the penetration rate of the drilling system by helping reduce the amount of material that is re-drilled as well as reducing friction resulting in the material being compacted at or near the end of the drilling system. Further, such a configuration can help reduce the compaction of the material between the core barrel 150 and the outer casing 125, which in turn may reduce friction and/or reduce contamination of a resulting core sample.

In the illustrated example, the drilling system is a wireline type system in which the core barrel 150 is tipped with a lift bit. In at least one example, as illustrated in FIG. 1C, a lift bit 200 can be coupled to the outer casing 125. Such a configuration can allow the lift bit 200 to sweep drilled material away from the drilling interface and into the annular space between the formation and the outer casing 125. In still other examples, both lift bits can be coupled to each of the outer casing 125 and the core barrel 150 in a wireline system.

While a wireline type system is illustrated in FIGS. 1B and 1C, it will be appreciated that a drilling system can include drill rods that are coupled together to form an outer casing and inner drill rods that are coupled together to form an inner drill string. A lift bit 200 can be coupled to the end of the outer casing and/or the inner drill string. In the illustrated example, the lift bit is coupled to the inner drill string and is configured to sweep drilled material into the annular space between the inner drill string and the outer casing. It will be appreciated that the lift bit 200 can be used with any number of drill string configurations.

Figure 2A:
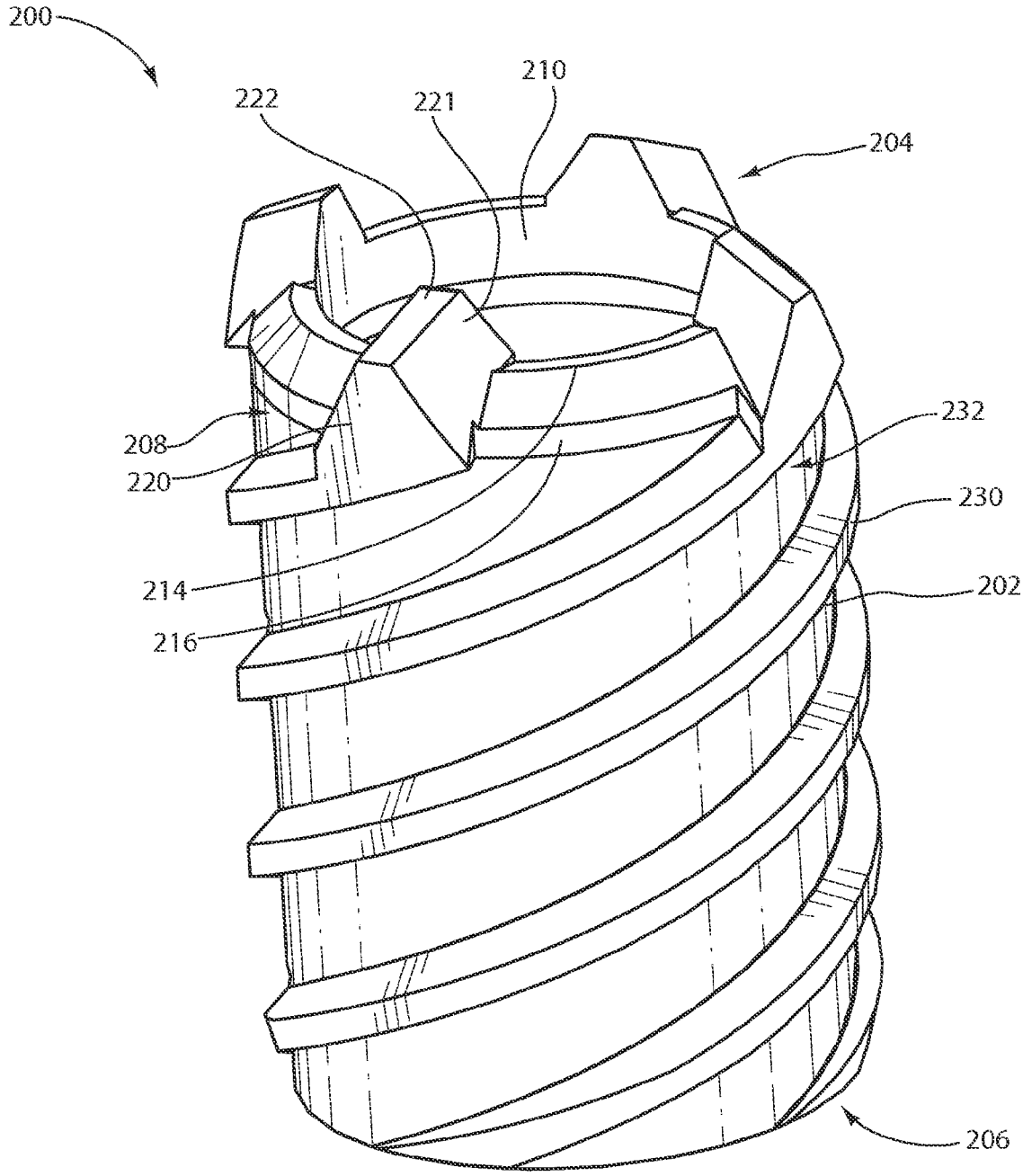
FIG. 2A illustrates a lift bit according to one example.
Figure 2B:
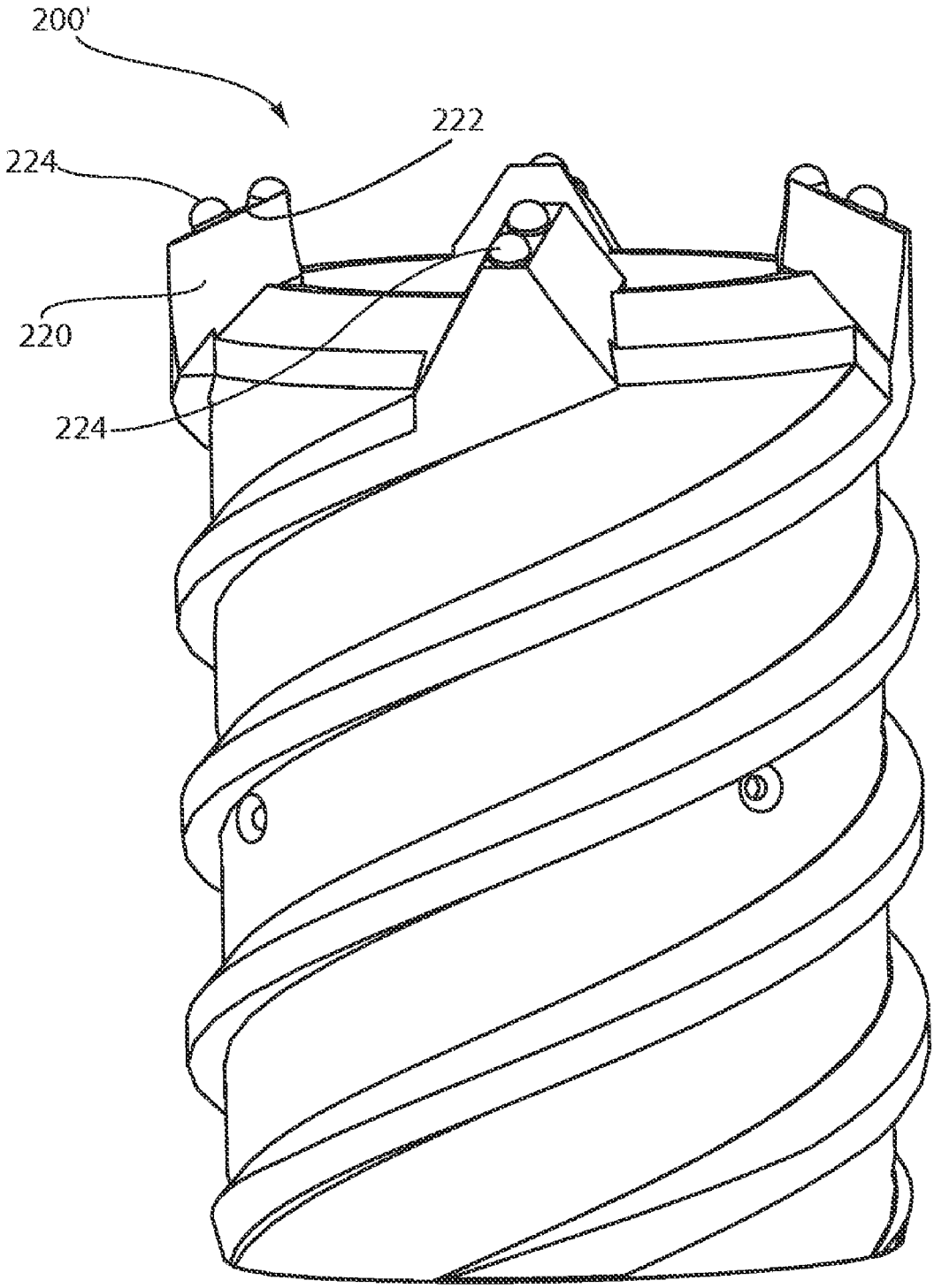
FIG. 2B illustrates a lift bit according to one example.

The lift bits described herein can have any configuration consistent with their operation described herein. FIGS. 2A and 2B illustrated a lift bit 200 according to one example. As illustrated in FIG. 2A, the lift bit 200 includes body 202 having a first end 204. The first end 205 can a width at a tip ranging from about 1/16 to about 1/8 inch to a broader portion having a width ranging from about 1/2 inch to about 3/4 inch. The body 202 also includes a back 206 that is located on the opposite end of the body 202 relative to the first end 204. The back 206 is configured to be positioned adjacent to and/or to couple with a core barrel. The body 202 also contains an outer surface 208 and an inner surface 210. While the outer diameter of the outer surface 208 of the lift bit 200 can be varied to obtain any desired core sample size, the diameter typically ranges from about 2 to about 12 inches.

In at least one example, the inner surface 210 of the body 202 has a varied inner diameter though which the core sample can pass from the first end 204 where it is cut, out the back 206 of the lift bit 200, and into a core barrel. While any size and configuration of body 202 can be used, in the illustrated example the body 202 has a substantially cylindrical shape. Further, the lift bit 200 can be configured such that as it coupled to a core barrel, the inner diameter of the body 202 can taper from a smaller inner diameter near the first end 204 to a larger inner diameter. Such a configuration can help retain the core sample.

The first end 204 of the lift bit 200 can have various configurations. In at least one example, the first end 204 has a tapered shape beginning with a narrow portion 214 that transitions to a broader portion 216. The angle of the taper from the narrow portion 214 to the broader portion 216 can vary as desired.

The lift bit 200 can also include inserts 220 coupled to the body 202. The inserts 220 can be used to move or sweep the material displaced during the drilling action away from the first end 204. As well, the inserts 220 can also provide the desired drilling action. Thus, the inserts 220 can be given any configuration desired, such as substantially rectangular, round, parallelogram, triangular shapes and/or combinations thereof.

In the example illustrated in FIG. 2A, the inserts 220 can have a substantially, truncated pyramidical shape that include leading surfaces 221 and cutting surfaces 222. Further, the cutting surfaces 222 of the inserts 220 can be provided as discrete surfaces with a substantially rectangular shape. The configuration of the cutting surfaces 222 as discrete surfaces can serve effectively in the sonic cutting action. It will also be appreciated that the shape of these surfaces can be any that achieves function, rather than rectangular. In other examples, the cutting surface can be substantially continuous. Further, while four of discrete cutting surfaces 222 are depicted in FIG. 2A, it will be appreciated that any number of cutting surfaces may be used, from a single continuous surface, to as many as eight, twelve, or more.

In the example shown in FIG. 2A, the inserts 220 can be substantially planar. As shown in FIG. 2B, a lift bit 200' can having buttons 224 coupled to the inserts 220. The buttons 224 can be embedded or otherwise secured to the cutting surfaces 222. Regardless of the configuration, the inserts 220 can be made of any material known in the drilling art. Examples of some of these materials include hardened tool steels, tungsten carbides, etc.

Referring to both FIGS. 2A and 2B, the number of inserts 220 selected can vary and can depend on numerous factors including the material of the formation being drilled. The inserts 220 used in a single drill bit can be shaped the same or can be shaped differently.

The lift bit 200 further includes helical bands 230 coupled to the outer surface 208 of the body 202. As shown in FIGS. 2A and 2B, the helical bands 230 can be aligned with the inserts 220 so that the helical bands 230 work in combination with the inserts 220 to move the displaced material away from the first end 204 of the body 202. In other instances, though, the helical bands 230 are not be aligned with the inserts. Further, any number of helical bands 230 can be provided.

For example, FIGS. 2A and 2B illustrate that the number of helical bands 230 and the number of inserts 220 can be the same. In other examples, the number of helical bands 230 can be more or less than the number of inserts 220. The number of helical bands 230 can depend on the diameter of the lift bits 200, 200'. For example, the number of helical bands 230 can range from one to about eight or more, such as a number of between about four and six.

Further, as illustrated in FIGS. 2A and 2B, channels 232 can be created between any two adjacent helical bands 230. Since the outer surface of the helical bands is usually proximate the borehole, the channels 232 can be used to contain the displaced material and direct the movement of the material axially up along the body 202 of the lift bits 200, 200'.

The helical bands, and therefore the channels, can be located on the outer surface 208 with a variety of configurations of locations, depths, and angles. In some embodiments, the helical bands 230 are located along the side of the lift bit with a distance of about 0.5 to about 6 inches from one point on the helical band to the corresponding location on the next helical band. In other embodiments, this distance can range from about 3 to about 5 inches.

The channels (flutes) 232 can have any width and depth that will move the displaced material along the length of the lift bit. In some embodiments, the channels 232 can have a width ranging from about ½ to about 1½ inches and a depth of about ⅛ to about ⅜ inch. In other embodiments, the channels 232 can have a width ranging from about ¾ to about 1¼ inches and a depth of about 3/16 to about 5/16 inch.

The channels 232 can also be oriented at an angle relative to the central axis that also aids in moving the displaced material upwards along the length of the outer casing. In at least one example, the helical bands 230 can be oriented at an angle ranging from about 1 to about 89 degrees, such as at an angle ranging from about 5 to about 60 degrees.

Using the drills bits described above, the material displaced from the formation being drilled can be forced away from the bit face. Initially, the displaced material can be pushed away from the core barrel entrance because of the angles of the carbide cutting teeth and the outer taper on the first end 204. The helical bands 230 and the channels 232 will then push the displaced material further away from the bit face upwards along the length of the outer casing. This movement reduces or prevents the displaced material from being re-drilled which can cause heat. This movement also reduces or prevents the displaced material from being forced out into the formation on the side of the outer casing or core barrel which can compact and alter the natural characteristics of the formations. This movement of the displaced material also reduces or prevents it from accumulating in the annular space between the outer diameter of the core barrel or outer casing and the borehole wall which can cause heat and stuck casing.

Figure 3A:
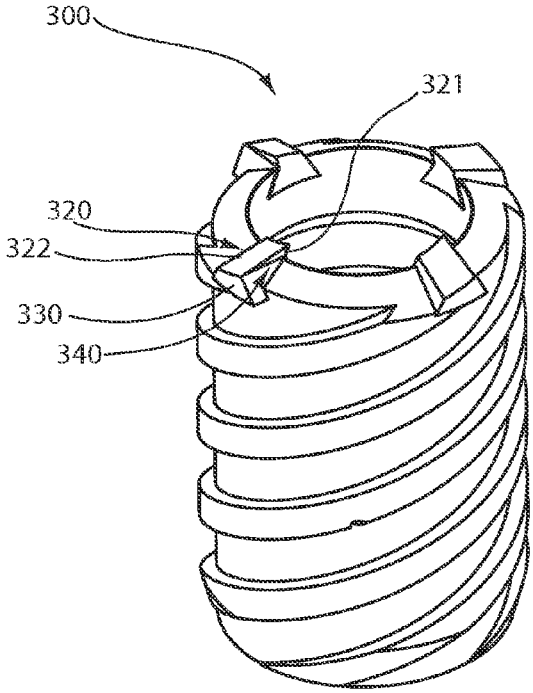
FIG. 3A illustrates a perspective view of a lift bit according to one example.

FIG. 3A illustrates a lift bit 300 that includes inserts 320 that have a bladed configuration. In such a configuration, each insert 320 includes a base 330 and a cutting blade 340. In the illustrated example, the cutting blade 340 tapers as it extends away from the base 330. The taper and angle of the cutting blade are illustrated in more detail in FIG. 3B.

Figure 3B:
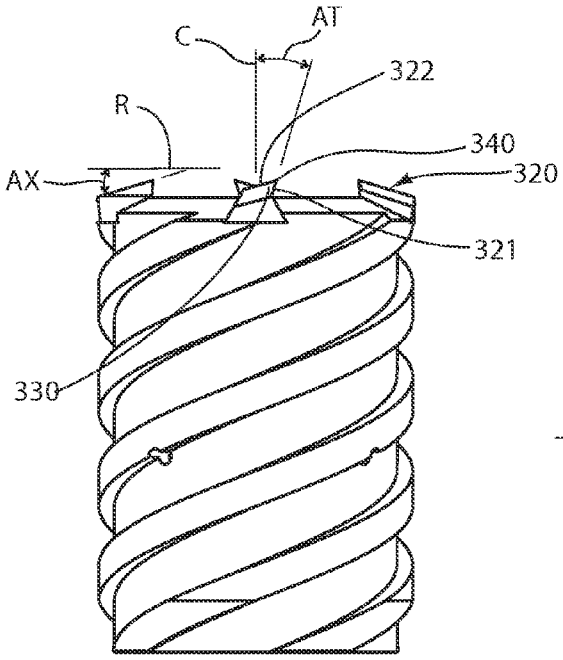
FIG. 3B illustrates an elevation view of a lift bit according to one example.

FIG. 3B illustrates an elevation view of the lift bit 300. The orientation of the surfaces of the cutting blade 340 can be described relative to a central axis C. The surfaces of the cutting blade 340 include a leading edge 321 and a top or cutting edge 322. As illustrated in FIG. 3B, an angle of attack AT can be described that is taken along the first surface and a line parallel to the central axis C. In the examples illustrated above, an attack angle of the inserts 220 can be measured relative to leading surfaces 222.

Sonic drill bits cut through the formation using various combinations of rotation, pressure, and vibration. In some aspects, the inserts 220, 320 of the lift bits 200, 200', 300 can have an attack angle AT designed to counter or offset the upward axial forces on the insert caused by the resistance of the formation to the vibration and pressure exerted on the bit. The degree of the attack angle AT can be selected to provide desired support for the inserts 220, 320 and the ability to shave off material from the formation and move it in the axial direction. Thus the degree of the attack angle will vary. For example, the attack angle AT can vary between about −60 to about 160 degrees. In another example, the attack angle AT can be between about 10 degrees and about 60 degrees. In yet another example, the attack angle AT can be between about 5 degrees and about 35 degrees.

In some instances, the inserts 220, 320 can also be inserted into the bit face at an axial angle AX. The axial angle AX can be measured relative to a radius R. The radius R is perpendicular to the center axis C. Such a configuration can reduce the effect of the rotational force applied to the inserts 220, 320. In at least one example, the axial angle AX can be between about 60 degrees and about 150 degrees, such as between about 60 degrees and 120 degrees. In another example, the axial angle AX can be between about 10 degrees and about 60 degrees. In yet another example, the axial angle AX can be between about 5 degrees and about 35 degrees.

Figure 3C:
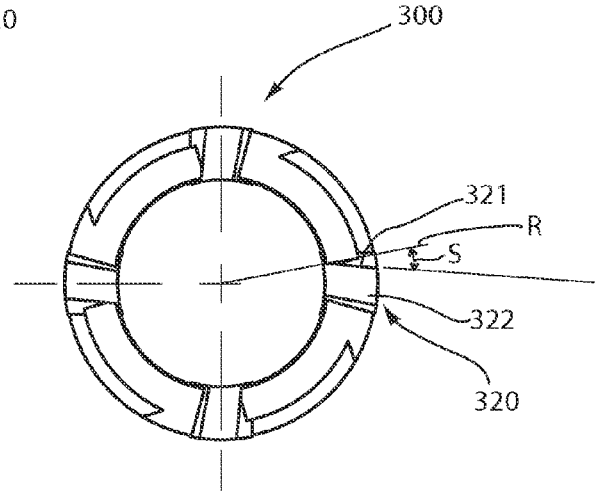
FIG. 3C illustrates a plan view of a lift bit according to one example.

In some instances, the inserts 220, 320 can also be oriented such that a line between the ends of the cutting surface 322 is oriented at a sweep angle S relative to the radius R. The sweep angle S of the insert 320 relative to the lift bit 300 is illustrated in FIG. 3C. The sweep angle S can also help to move or sweep displaced material away from the inserts 320, aiding in obtaining a better sample and reducing the re-drilling of cuttings and thereby increasing the efficiency of the drilling process. The sweep angle S can have any suitable degree. For example, the sweep angle S can be between about one degree and about 89 degrees. In at least one example, the degree of the sweep angle can range from about 5 to about 35 degrees. In other examples, the sweep angle S can range from about 15 to about 25 degrees. In yet other embodiments, the sweep angle S can be about 20 degrees. In still further embodiments, the sweep angle S can be between about 10 degrees and about 60 degrees.

The drill bits mentioned above can be made by any method that provides them with the configurations described above. In one exemplary method, a steel tube with the desired outer diameter is obtained. Next, it is machined conventionally. Then, channels are machined into the steel tube, thereby also creating the helical bands in the same process. The inserts are then created by sintering the tungsten carbide into the desired shape. When tool-steel inserts are used, they can be machined into the desired shape. The inserts are then soldered and/or press fit to the steel tube that has been machined. Where the inserts are tool steel, the drill bit could instead be made by creating a mold for the entire drill bit and then using an investment casting process to form the drill bit. The channels can be produced by machining the outer diameter of the rod, or can be produced by welding or fastening helical bands onto the outer diameter of the rod. The helical bands can be of materials harder or softer than the drill rod.

The drill bits described above can be used as part of a sonic drilling system that can be used to obtain a core sample. The lift bits 200, 200', 300 can be connected to a sonic (or vibratory) casing and/or core barrel. High-frequency, resonant energy is used to advance the core barrel and/or outer casing into the desired formation(s). During drilling, the resonant energy is transferred down the drill string to the core barrel and/or outer casing to the bit face at various sonic frequencies. Typically, the resonant energy generated exceeds the resistance of the formation being encountered to achieve maximum drilling productivity. The material displaced by the sonic drilling action is then moved away from the bit face and towards the drill string by the action of the inserts and the combination of the channels/helical bands.

Such a configuration can result in a lift bit that can help ensure the displaced material at the bit face is effectively and efficiently removed. This removal not only allows for reduced or minimal disturbance, it also allows for much faster more efficient drilling because the displaced material is simply pushed out and then lifted away from the bit face as opposed to the wasted time and energy that can be expended while re-drilling, compacting, and/or otherwise forcing this displaced material either where it should not be (in the core barrel), where it does not want to go (into the formation), or into the annular space where it can cause friction and heat and can cause stuck core barrels and outer casings.

In addition to any previously indicated modification, numerous other variations and alternative arrangements may be devised by those skilled in the art without departing from the spirit and scope of this description, and appended claims are intended to cover such modifications and arrangements. Thus, while the information has been described above with particularity and detail in connection with what is presently deemed to be the most practical and preferred aspects, it will be apparent to those of ordinary skill in the art that numerous modifications, including, but not limited to, form, function, manner of operation and use may be made without departing from the principles and concepts set forth herein. Also, as used herein, examples are meant to be illustrative only and should not be construed to be limiting in any manner.

The invention claimed is:

1. A drill bit for core sampling, comprising:

a body having a central axis, an inner surface, and an outer surface, said body further including a first end and a second end, said second end being configured to be secured to a drill string component, said first end having an outer surface that tapers from said outer surface of said body toward the central axis; and at least one insert secured to said first end, said at least one insert having a cutting surface that extends radially outward from said inside surface at an axial angle relative to a plane extending perpendicular to the central axis to move material displaced during drilling away from said first end.

2. The drill bit of claim 1, wherein said axial angle of said cutting surface is between about 5 degrees and about 35 degrees.

3. The drill bit of claim 1, wherein said at least one insert includes a leading surface, wherein said leading surface is oriented at an angle of attack between about 10 degrees and about 60 degrees relative to the central axis.

4. The drill bit of claim 1, wherein said at least one insert includes a leading surface, wherein said leading surface is angled at a sweep angle of between about 10 degrees and about 60 degrees relative to a line extending from the central axis to said leading surface, the line being normal to the central axis.

5. The drill bit of claim 1, wherein said first end has a width at a tip ranging from about 1/16 inch to about 1/8 inch to a broader portion having a width ranging from about 1/2 inch to about 3/4 inch.

6. The drill bit of claim 1, wherein said at least one insert includes a base and a bladed cutting surface extending away said base.

7. The drill bit of claim 1, further comprising a plurality of helical bands coupled to said outer surface of said body.

8. The drill bit of claim 7, further comprising a channel between adjacent helical bands.

9. The drill bit of claim 8, wherein said helical bands are each aligned with an insert.

10. A sonic drill bit for core sampling, comprising:

a body having a central axis, an outer surface, an inner surface, a first end, and a second end, said body defining an interior space about the central axis for receiving a core sample;

an insert on said first end having a cutting surface and a leading surface, said cutting surface extending from said inner surface radially outward at being oriented at an axial angle of between about 5 degrees and about 60 degrees relative to a plane extending perpendicular to the central axis, said leading surface being angled at a sweep angle of between about 5 degrees and about 60 degrees relative to a line extending from the central axis to said leading surface, the line being normal to the central axis; and a channel on said outer surface of said body.

11. The drill bit of claim 10, wherein said axial angle is between about 5 and about 35 degrees.

12. The drill bit of claim 10, wherein said sweep angle is between about 5 and about 35 degrees.

13. The drill bit of claim 10, further comprising a plurality of helical bands on said outer surface of said body.

14. The drill bit of claim 12, wherein said channel is located between adjacent helical bands.

15. The drill bit of claim 13, wherein each helical bands is aligned with an insert on said first end.

16. A drill bit for core drilling, comprising:

a body defining an interior space about a central axis for receiving a core sample, said body including a first end, a second end, an inner surface, and an outer surface, said first end having an outside surface that tapers from said outer surface toward the central axis;

an insert on first end, said insert including a leading surface which is oriented at sweep angle relative to a line extending from the central axis to said leading surface, the line being normal to the central axis, said sweep angle being between about 5 degrees and about 60 degrees; and a helical channel on said outer surface of said body.

17. The drill bit of claim 16, wherein a top surface of said insert is oriented at an axial angle of between about 5 degrees and about 60 degrees relative to a plane extending perpendicular to the central axis.

18. The drill bit of claim 16, wherein said leading surface is further oriented at an attack angle of between about 5 degrees and about 60 degrees relative to the central axis.

19. The drill bit of claim 16, wherein said sweep angle is between about 5 and about 35 degrees.

20. The drill bit of claim 16, wherein rotation of said drill bit moves material to a channel between a plurality of helical bands on said outer surface of said body.

21. The drill bit of claim 18, wherein a top surface of said insert is oriented at an axial angle of between about 5 degrees and about 60 degrees relative to a plane extending perpendicular to the central axis.

* * * * *

UNITED STATES PATENT AND TRADEMARK OFFICE

CERTIFICATE OF CORRECTION

PATENT NO. : 7,984,773 B2
APPLICATION NO. : 12/346395
DATED : July 26, 2011
INVENTOR(S) : Thomas J. Oothoudt It is certified that error appears in the above-identified patent and that said Letters Patent is hereby corrected as shown below:

Drawings

Sheet 2, replace Figure 1B with the figure depicted below, wherein the first instance of reference number "125" has been changed to --120--

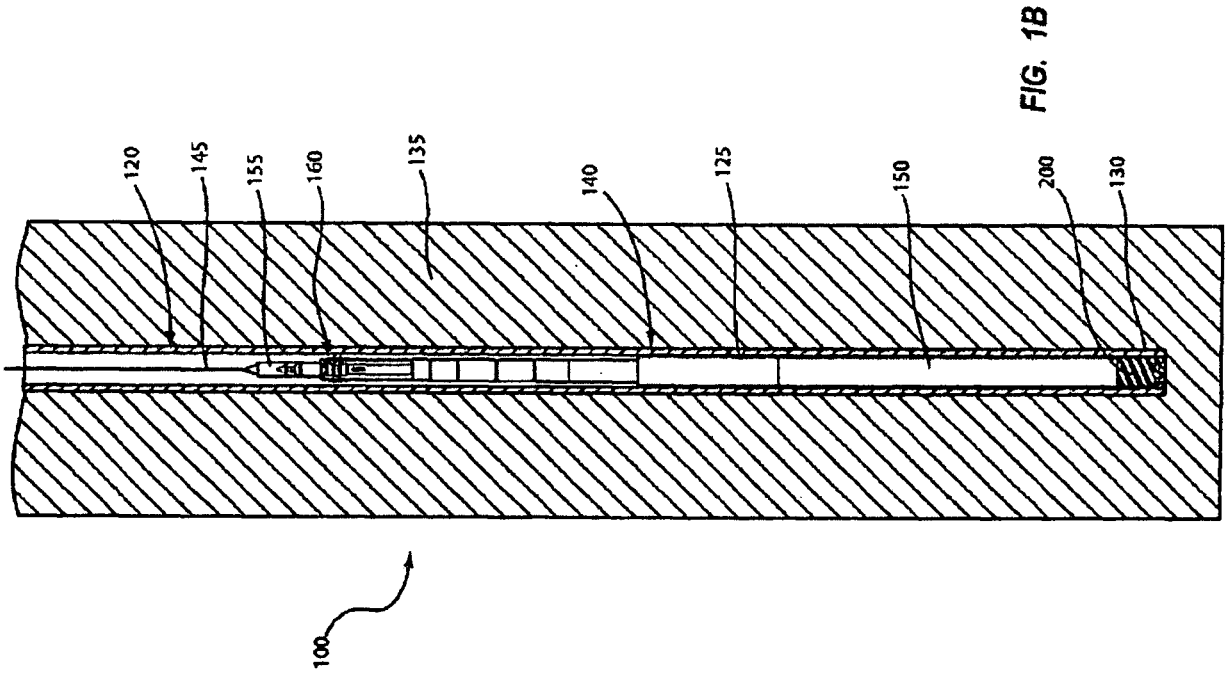

Sheet 3, replace Figure 1C with the figure depicted below, wherein the first instance of the reference Signed and Sealed this
Twenty-second Day of November, 2011

David J. Kappos

David J. Kappos
*Director of the United States Patent and Trademark Office* number "125" has been changed to --120--

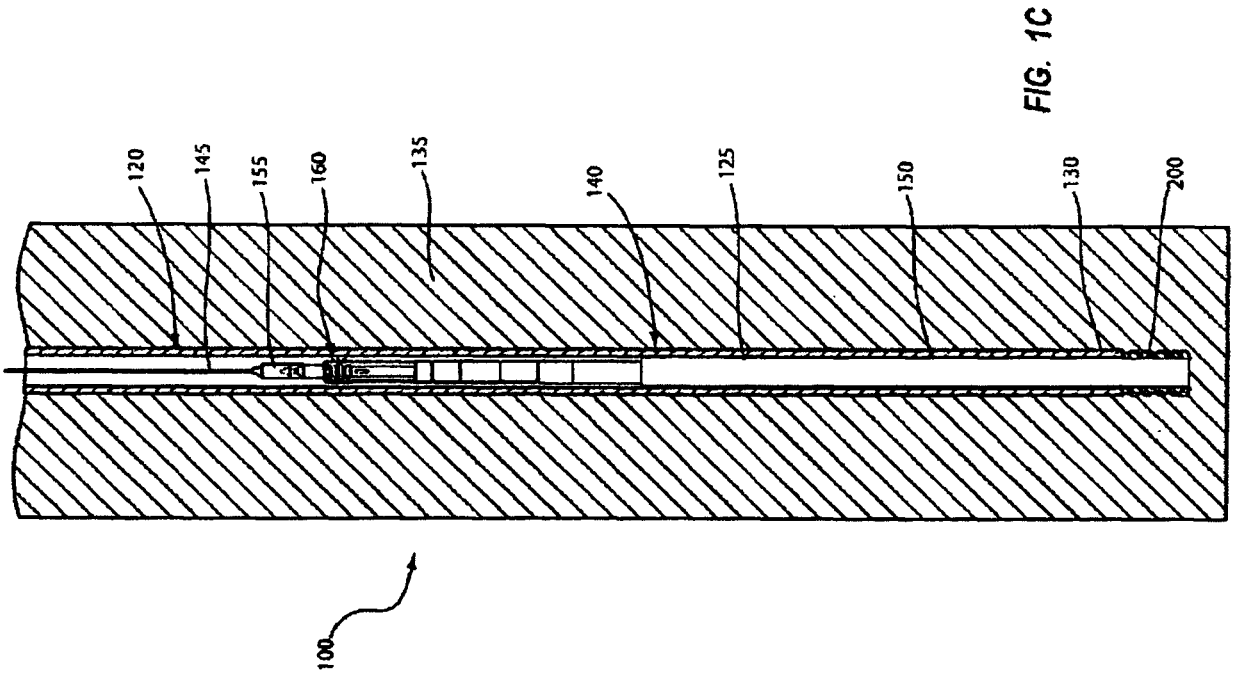

Column 1
Line 17, change "wells" to --well--

Column 2
Line 61, change "FIG." to --FIGS.--

Column 4
Line 23, change "first end 205 can a width" to --first end 204 can have a width--
Lines 40-41, change "such that as it coupled" to --such that when it is coupled--

Column 5
Line 8, change "having" to --have--
Line 25, delete "be"
Line 62, change "drills" to --drill--

Column 8
Line 43, after "outward at" remove [being oriented at]
Line 60, change "helical bands" to --helical band--